US011292021B1

(12) United States Patent
Cumblidge

(10) Patent No.: US 11,292,021 B1
(45) Date of Patent: Apr. 5, 2022

(54) ADJUSTABLE LANDSCAPING MARKING IMPLEMENT

(71) Applicant: Tim Cumblidge, Middlefield, OH (US)

(72) Inventor: Tim Cumblidge, Middlefield, OH (US)

( * ) Notice: Subject to any disclaimer, the term of this patent is extended or adjusted under 35 U.S.C. 154(b) by 377 days.

(21) Appl. No.: 16/392,778

(22) Filed: Apr. 24, 2019

(51) Int. Cl.
*B05B 15/60* (2018.01)
*B05B 3/00* (2006.01)
*B05B 13/04* (2006.01)

(52) U.S. Cl.
CPC ..... *B05B 15/60* (2018.02); *B05B 3/00* (2013.01); *B05B 13/0426* (2013.01)

(58) Field of Classification Search
USPC ..... 118/321, 323; 116/209, 211; 222/174; 47/32.4, 32.5
See application file for complete search history.

(56) References Cited

U.S. PATENT DOCUMENTS

| | | | | |
|---|---|---|---|---|
| 3,485,206 | A * | 12/1969 | Smrt | E01C 23/227 118/305 |
| 5,367,822 | A | 11/1994 | Beckham | |
| 5,794,378 | A | 8/1998 | Beatrez | |
| 5,918,565 | A * | 7/1999 | Casas | G01C 15/02 116/211 |
| 5,921,021 | A | 7/1999 | Coates | |
| 6,367,194 | B1 | 4/2002 | Measday et al. | |
| 9,687,101 | B2 | 6/2017 | Reetz et al. | |
| 9,980,441 | B2 | 5/2018 | Rynberk, Jr. | |
| 2010/0186293 | A1 | 7/2010 | Flynn | |
| 2019/0104728 | A1* | 4/2019 | Howell, Jr. | A01K 5/00 |
| 2019/0269989 | A1* | 9/2019 | Gladwin | A63B 63/00 |

* cited by examiner

*Primary Examiner* — Yewebdar T Tadesse
(74) *Attorney, Agent, or Firm* — Cramer Patent & Design, PLLC; Aaron R. Cramer

(57) ABSTRACT

An adjustable landscaping marking tool includes a strap having a hook disposed at a strap first end, a hook receiving ring disposed on an adjustable connector at a middle section, and at least one (1) marking device aperture disposed at a strap second end. The device is configured to permit a user to secure the hook about a vertical support structure. A marking means secured within a desired marking device aperture may then be used to circumscribe a mark on the ground surface around the vertical support structure.

20 Claims, 4 Drawing Sheets

ADJUSTABLE LANDSCAPING MARKING IMPLEMENT

FIELD OF THE INVENTION

The presently disclosed subject matter is directed to landscaping tools. More particularly it is directed to landscaping marking devices that assist landscapers to produce quality landscape layouts.

BACKGROUND OF THE INVENTION

There are millions of homes and buildings in the United States. Those homes and buildings represent an aggregate worth of trillions of dollars. While those homes and buildings range from small shacks to exquisite multi storied structures they have at least one thing in common: they are built on land.

The land that a building sits on represents not only a geophysical location but one that inherently includes visible features such as hills, trees, lakes, roads, vistas as well as the building(s) situated on it. For both aesthetics and financial value it is highly beneficial to integrate a home or building with its land. To that end a home or building and the land it sits on can be designed or developed to fit together in an artistically pleasing fashion.

Land can be developed to fit with structures on it as well as with lighting, roads, location and natural background. To that end the characteristics of land can be modified according to a landscaping plan. Such a plan may include trees, walkways and roads, grass, fences, and a wide range of additional features.

Very often in landscaping there is a need for well-defined areas around various structures such as trees and walls. For example, the area around a particular tree might be carefully cultivated in flowers or gravel may be deposited around the base of the tree. While such may be aesthetically pleasing in practice actually laying out a landscaping plan can be far from trivial.

Consider the problem of forming a base around a tree that grows out of a hill. It becomes extremely difficult to accurately locate and measure the desired base around a structure. In view of such difficulty in the prior art relatively inaccurate base layouts were often deemed acceptable or expensive and time-consuming plotting was performed.

In view of the foregoing it would be beneficial to have a landscape marking tool that allows accurate base layouts around vertical structures such as trees. Preferably such landscape marking tools would be accurate and easy to use. Even more preferably such tools would be suitable for use by both professionals and amateur landscapers and would be suitable for being made available at low cost. Ideally, such landscape marking tools would be reusable and safe to use.

SUMMARY OF THE INVENTION

The principles of the present invention provide for landscape marking tools that enable accurate base layouts around vertical structures. Landscape marking tools that are in accord with the present invention can be implemented in a manner in which they produce accurate results and are easy to use, both by professionals and by amateur landscapers. In addition, landscape marking tools that are in accord with the present invention are suitable for being made available at low cost. Finally, such landscape marking tools can be made reusable and are safe to use.

A landscape marking tool that is in accord with the present invention includes a first strap, a first connection that is attached to a first end of the first strap, a marking device, and a second strap for receiving the marking device. That landscape marking tool further includes an adjustable connector having a second connection for receiving the first connection. The adjustable connector includes features for securing the first and the second straps to the adjustable connector. The first strap can wrap around a vertical structure such that the first connection attaches to the second connection, and such that the marking device can deposit a mark around the vertical structure.

The landscape marker may be comprised of nylon and it may include a protective coating. In practice it is beneficial if the first strap is comprised of a webbed material. In any event the second strap may have an aperture for receiving the marking device. That aperture may have a protective grommet around it. The first connection might be a hook and the second connection might be a ring. If the first strap is flat the hook preferably lies in the same plane as the first strap first end. The first strap first end beneficially includes a sewn loop that captures the hook. In any event the ring may pass through an aperture in the adjustable connector and/or it might be pivotally attached to the adjustable connector. Alternatively, it might be rigidly attached to the adjustable connector. The adjustable connector might include a cam locking adjuster for receiving and securing the second strap to the adjustable connector.

An alternative landscape marker has a first strap with a first strap first end, a hook attached to the first strap first end, a marking device, a second strap for receiving the marking device, and a ratcheting connector. That ratcheting connector includes a ring for receiving the hook. The ratcheting connector receives the first and the second straps such that the ratcheting connector can adjust the external length of at least the first strap. The first strap can wrap around a vertical structure such that the hook attaches to the ring and such that the marking device can deposit a mark around the vertical structure.

That alternative landscape marker can be configured such that the first strap is nylon and/or it may be webbed. In any event that second strap might include an aperture for receiving the marking device. That aperture may have a protective grommet. Preferably the hook lies in the same plane as the first strap first end. Also, preferably the hook is sewn to the first strap first end.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DESCRIPTIVE KEY

Figure 1:
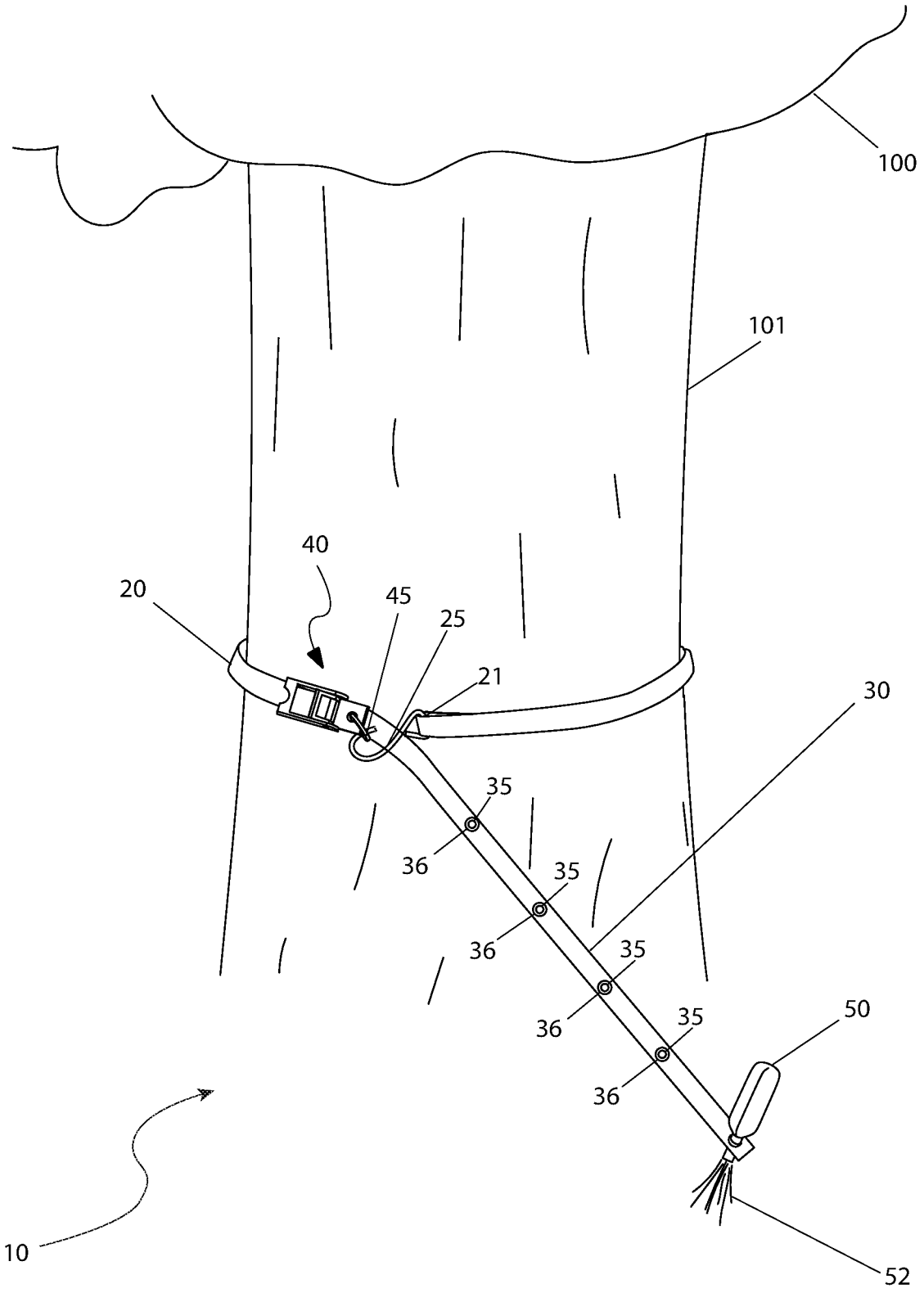
FIG. 1 is an environmental view of a landscape marker 10 that is in accord with a preferred embodiment of the present invention.

10 landscape marker
20 first strap
21 first strap first end
22 first strap second end
25 hook
30 second strap
31 second strap first end
32 second strap second end
35 marking device aperture
36 protective grommet
40 adjustable connector
41 adjustable connector first end
42 adjustable connector second end
43 cam locking adjuster
44 notch
45 ring
46 ring aperture
50 marking device
52 spray
100 tree
101 trunk
140 alternate adjustable connector
141 alternate adjustable connector first end
142 alternate adjustable connector second end
145 alternate ring

DESCRIPTION OF THE PREFERRED EMBODIMENTS

The preferred embodiment of the present invention is depicted in FIGS. 1 through 5*b*. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one of the referenced items.

Refer now to FIG. 1 for an environmental view of a landscape marker 10 that is in accord with the present invention. In FIG. 1 the landscape marker 10 is shown installed around the trunk 101 of a tree 100 in a manner that is suitable for marking about that trunk 101. While the landscape marker 10 is shown installed on a tree 100 it should be understood that it can be installed on other types of vertical support surfaces about which landscape markings are desired.

The landscape marker 10 enables a user to easily mark a circumferential outline about the vertical support surface on which it is installed. For example, when installed on the trunk 101 of a tree 100 a user can layout a generally circular landscaping mark about the tree 100. In practice the landscape marker 10 is adjustably attached to the vertical support surface somewhat loosely to enable rapid traversal about the vertical support surface. An accurate marking can then be obtained quickly and easily.

The marking itself is produced by a marking device 50 that is inserted into a selected marking device aperture 35 of a second strap 30 (described in more detail subsequently). The marking device 50 is capable of spraying or otherwise dispensing a marking spray 52 onto the ground (or onto another surface).

Figure 2:
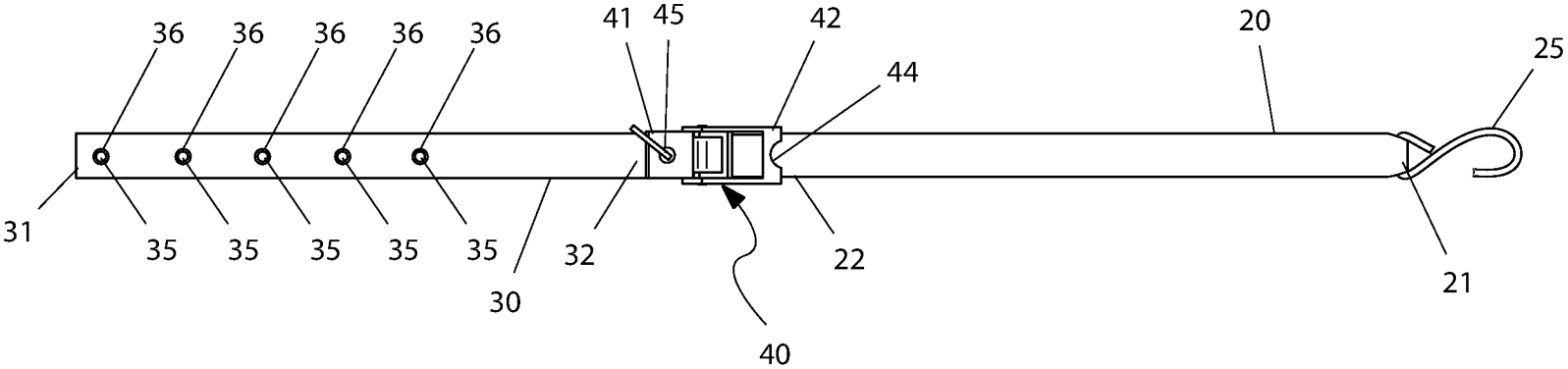
FIG. 2 is a rear view of the landscape marker 10 shown in FIG. 1.
Figure 3:
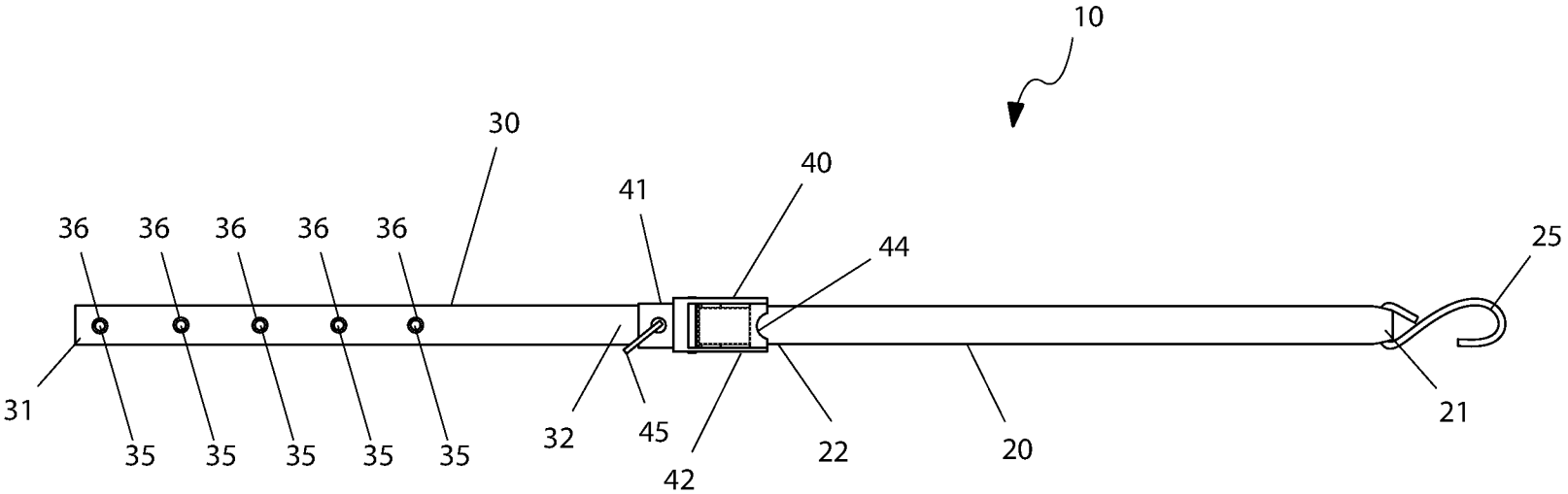
FIG. 3 is a front view of the landscape marker 10 shown in FIGS. 1 and 2.

Still referring to FIG. 1, and also to FIGS. 2 and 3 (respectively rear and front views of the landscape marker 10) the landscape marker 10 includes a composite strap assembly. That composite strap assembly is comprised of a first strap 20, a second strap 30, and an adjustable connector 40 which connects the first and second straps 20, 30 together. The first strap 20 and the second strap 30 are preferably made of nylon or another strong, waterproof, resilient material capable of withstanding the handling and abrasive movements of the landscape marker 10. In addition, it is preferable that a protective coating be applied onto or impregnated into the strap material for additional protection. In practice, the first strap 20 and the second strap 30 may be made of a relatively flat, webbed material.

The adjustable connector 40 is slidably engaged within the straps 20, 30. The adjustable connector 40 includes a cam locking adjuster 43 (best seen in FIG. 5*a*) or another type of buckle that enables adjusting the desired lengths of at least the first strap 20 and possibly the second strap 30 so as to prevent inadvertent slippage of those straps 20, 30.

Figure 5A:
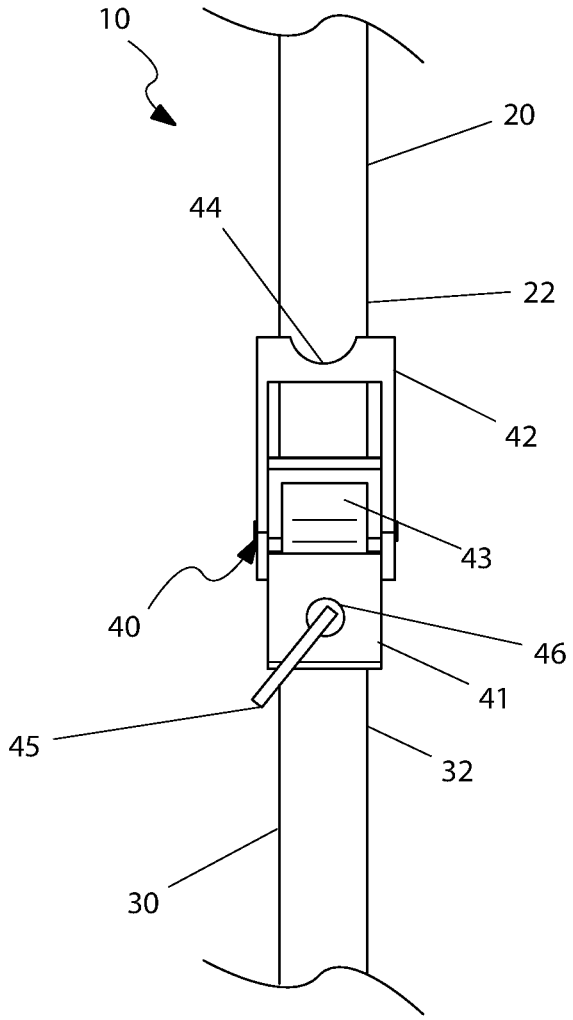
FIG. 5*a* is a close-up view of an adjustable connector 40 used in the landscape marker 10 shown in FIGS. 1 through 3; and, FIG. 5*b* is a close-up view of an alternate adjustable connector 140 suitable for use in the landscape marker 10 shown in FIGS. 1 through 3.

In practice the first and second straps 20, 30 and the adjustable connector 40 are a form of a modified ratcheting tie down connection. The adjustable connector 40 can take the form of a ratcheting buckle. The first strap 20 has a first strap first end 21 that is located opposite the adjustable connector 40 and a first strap second end 22 that engages with a first feature 42 (such as a rotating slotted cylinder) of the adjustable connector 40. Similarly, the second strap 30 has a second strap first end 31 that is located opposite the adjustable connector 40 and a second strap second end 32 that engages with a second feature 41 (again, possibly a rotating slotted cylinder) of the adjustable connector 40. Aspects of the foregoing are illustrated in FIG. 5*a*.

Figure 4:
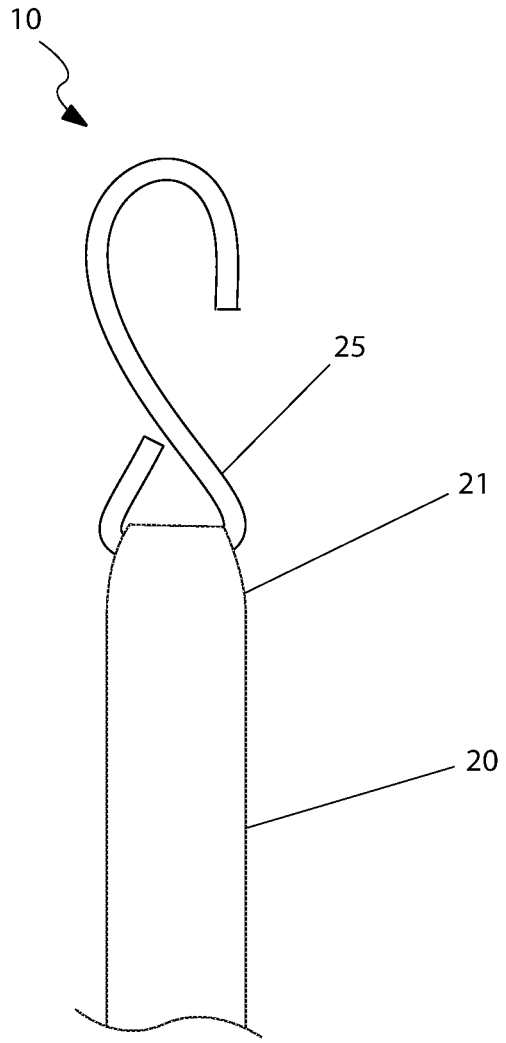
FIG. 4 is a close-up view of a hook 25 used in the landscape marker 10 shown in FIGS. 1 through 3.

Referring now to FIGS. 1-5*a*, at the first strap first end 21 is a hook 25. That hook 25 is removably attachable to a ring 45 that is pivotally affixed to the adjustable connector 40 (as described in more detail below). The hook 25 is preferably affixed my sewing a loop at the first strap first end 21 with the hook 45 captured therein. Preferably the hook 25 extends outward from the first strap first end 21 in the same plane as the first strap 20. This is illustrated in FIG. 4. The purpose of this is to reduce twisting and binding of the landscape marker 10 when it is installed on a vertical structure and such that the hook 25 can lay relatively flat relative to the vertical structure.

Located along the second strap 30 are the previously mentioned marking device apertures 35. Each marking device aperture 35 is sized to receive a nozzle of the marking device 50 such that the nozzle extends therethrough. In an exemplary embodiment each marking device aperture 35 enables the spraying nozzle of the marking device 50 to extend therethrough while the remainder of the marking device 50 does not. This enables a marking spray 52 to be accurately delivered during a marking event. Each marking device aperture 35 may have a protective grommet 36 surrounding it to protect the marking device aperture 35 from damage. This is particularly useful when a flat webbed material is used for the second strap 30.

Preferably, the marking device apertures 35 are equally spaced along the longitudinal center-line of the second strap 30. For example, the marking device apertures 35 are can be spaced at two foot (2 ft.) intervals. In practice it has been found useful that the marking device aperture 35 closest to the second strap second end 32 is about six feet (6 ft.) away from the vertical support structure while the marking device apertures 35 farthest from the vertical support structure is about twelve feet (12 ft.) away.

Referring now specifically to FIG. 5*a*, the adjustable connector 40 incorporates an adjustable connector first end 41 which includes a cam locking adjuster 43 having a slotted feature, a slotted feature in the adjustable connector second end 42, and a ring 45. The adjustable connector first end 41 receives the second strap second end 32 in the slot of the cam locking adjuster 43. By advancing the cam locking adjuster 43 the second strap 30 may wrap itself around and thus become locked in the adjustable connector 40. Further rotation of the cam locking adjuster 43 advances wrapping the second strap 30 about the cam locking adjuster 43. As such, the cam locking adjuster 43 secures the second strap 30 at its desired position relative to the vertical support structure. Likewise, the first strap second end 22 is wrapped around a slotted feature in the adjustable connector second end 42 such that the first strap 20 becomes locked in the adjustable connector 40.

The adjustable connector second end 42 has a lever 44 with a semi-circular notch 44. The lever 44 enables the adjustable connector 40 to relatively tighten the first and second straps 20, 30 while restricting crimping of those straps 20, 30. At least the length of the first strap 20 that extends from the adjustable connector 40 can be adjusted by the lever 44.

The adjustable connector 40 includes ring apertures 46 that pass through the adjustable connector first end 41. The ring 45 is held within the ring apertures 46 on the side of the adjustable connector 40 that is to face the vertical support structure that the landscape marker 10 is installed on. The ring 45 is sized to receive the hook 25.

Figure 5B:
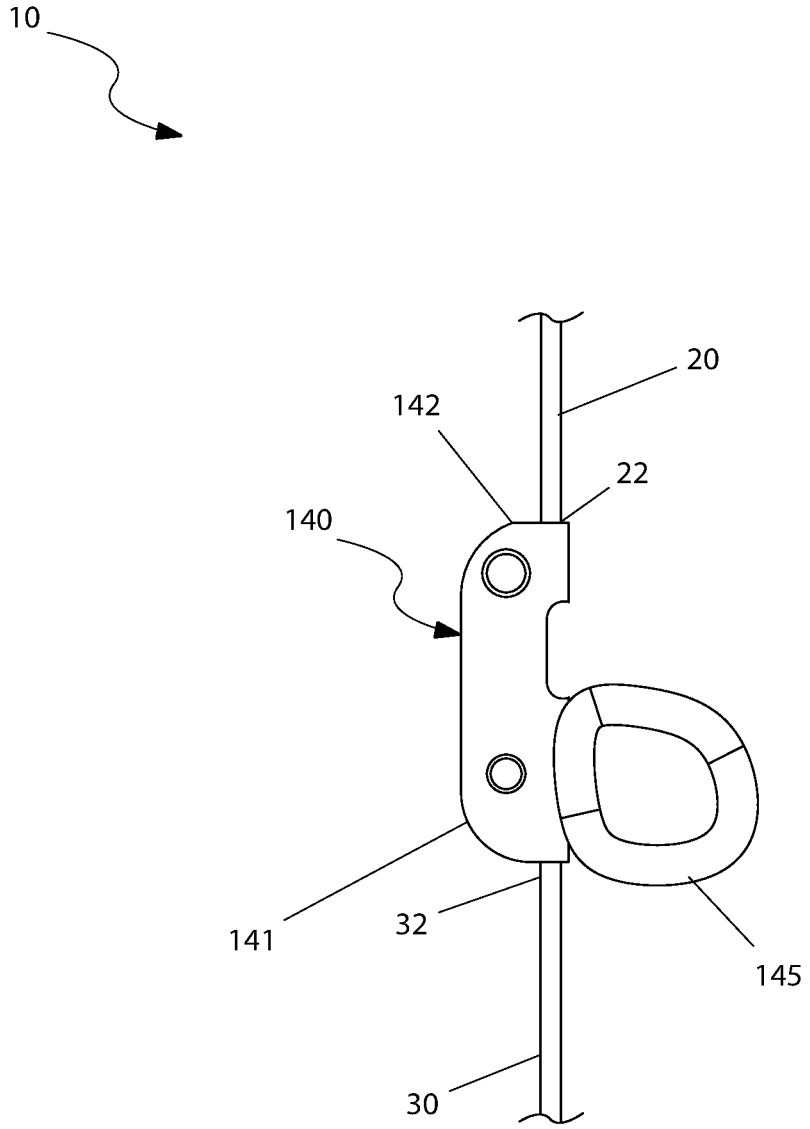

FIG. 5*b* illustrates an alternate adjustable connector 140 that is suitable for particularly heavy-duty landscape marker 10 applications. The alternate adjustable connector 140 includes an adjustable connector first end 141, an adjustable connector second end 142, and a ring 145. The ring 145 is rigidly affixed to the body of the alternate adjustable connector 140. The ring 145 operates a cam adjust mechanism to tighten at least the first strap 20. These features function in a similar manner to the adjustable connector 40.

The present invention can be utilized by the common user in a simple and effortless manner with little or no training. To install the landscape marker 10 on a vertical support surface (e.g., the trunk 101 of a tree 100) to use the landscape marker 10 to mark the desired area the following steps are performed: identifying a desired landscaping marking area about a vertical support structure; wrapping the first strap 20 around the vertical support structure; attaching the hook 25 to the ring 45 (or to the alternate ring 145); adjusting the adjustable connector 40 (or the alternate adjustable connector 140) until the first strap 20 has a slightly snug, but not overly tight fit on the vertical support structure; attaching the second strap 30 to the adjustable connector 40 (or to the alternative adjustable connector 140); placing the nozzle of the marking device 50 in a selected marking device apertures 35 such that a mark can be applied to the ground; depositing the spray 52 the ground while moving the composite strap assembly about the vertical support structure to produce the desired landscaping marking area.

If a generally circular landscaping marking area is desired, the distance between the marking device 50 and the vertical support structure must be maintained as close to a constant distance as possible. This can be achieved by providing a pulling force on the second strap first end 31 while holding the marking device 50 such that activation thereof applies the spray 52 at a consistent angle.

It is preferred that the hook 25 and the ring 45 (or the alternate ring 145) are positioned against the vertical support structure to protect them from the elements as much as possible when installing the landscape marker 10 on the vertical support structure and also to protect them from inadvertent impalement or snagging of a user or clothing or other material.

The foregoing descriptions of a specific embodiment of the present invention have been presented for purposes of illustration and description. They are not intended to be exhaustive or to limit the invention to the precise forms disclosed. Obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated.

The invention claimed is:

1. A landscape marker, comprising:

a first strap;

a first connection attached to a first end of said first strap;

a marking device;

a second strap for receiving said marking device; and an adjustable connector having a second connection for receiving said first connection, said adjustable connector having features for securing said first and said second straps to said adjustable connector;

wherein said first strap is configured to wrap around a vertical structure such that said first connection attaches to said second connection; and wherein said marking device is configured to deposit a mark around the vertical structure by moving around the vertical structure.

2. The landscape marker according to claim 1, wherein said first strap is comprised of nylon.

3. The landscape marker to according to claim 1, further including a protective coating on said first strap.

4. The landscape marker to according to claim 1, wherein said first strap is comprised of a webbed material.

5. The landscape marker to according to claim 1, wherein said second strap includes an aperture for receiving said marking device.

6. The landscape marker to according to claim 5, further including a protective grommet around said aperture.

7. The landscape marker to according to claim 1, wherein said first connection is a hook and wherein said second connection is a ring.

8. The landscape marker to according to claim 7, wherein said first strap is flat and wherein said hook lies in the same plane as said first strap of said first end.

9. The landscape marker to according to claim 7, wherein said first strap first end includes a sewn loop that captures said hook.

10. The landscape marker to according to claim 7, wherein said ring passes through an aperture in said adjustable connector.

11. The landscape marker to according to claim 7, wherein said ring is pivotally attached to said adjustable connector.

12. The landscape marker to according to claim 7, wherein said ring is rigidly attached to said adjustable connector.

13. The landscape marker to according to claim 1, wherein said adjustable connector includes a cam locking adjuster for receiving and securing said second strap to said adjustable connector.

14. A landscape marker, comprising:

a first strap having a first strap first end;

a hook attached to said first strap first end;

a marking device;

a second strap for receiving said marking device; and a ratcheting connector having a ring for receiving said hook, said ratcheting connector receiving said first and said second straps such that said ratcheting connector can adjust the external lengths of said first strap;

wherein said first strap is configured to wrap around a vertical structure such that said hook attaches to said ring; and wherein said marking device is configured to deposit a mark around the vertical structure.

15. A landscape marker assembly of claim 14, wherein said first strap is comprised of nylon.

16. The landscape marker to according to claim 14, wherein said first strap is comprised of a webbed material.

17. The landscape marker to according to claim 14, wherein said second strap includes an aperture for receiving said marking device.

18. The landscape marker to according to claim 17, further including a protective grommet around said aperture.

19. The landscape marker to according to claim 16, wherein said hook lies in the same plane as said first strap of said first end.

20. The landscape marker to according to claim 14, wherein said hook is sewn to said first strap first end.

* * * * *